US007219917B2

(12) United States Patent
Walker et al.

(10) Patent No.: US 7,219,917 B2
(45) Date of Patent: May 22, 2007

(54) CARTRIDGE RADIUS SURFACE

(75) Inventors: Ben Walker, Orem, UT (US); Mark Santurbane, Salt Lake City, UT (US); David Narajowski, Heber City, UT (US); David Mellon, Park City, UT (US); Thomas Laakso, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 131 days.

(21) Appl. No.: 10/881,592

(22) Filed: Jun. 30, 2004

(65) Prior Publication Data

US 2006/0001239 A1 Jan. 5, 2006

(51) Int. Cl.
*A63C 9/00* (2006.01)

(52) U.S. Cl. ..... 280/613; 280/634; 280/611; 280/615; 280/619

(58) Field of Classification Search ..... 280/613–622, 280/611, 11.15; *A63C 9/00, 9/06, 9/08, 9/083, A63C 9/24*
See application file for complete search history.

(56) References Cited

U.S. PATENT DOCUMENTS

| | | | | | |
|---|---|---|---|---|---|
| 2,367,836 | A * | 1/1945 | Brown | 16/2.1 |
| 2,717,792 | A * | 9/1955 | Pelley | 403/69 |
| 3,489,424 | A * | 1/1970 | Gertsch et al. | 280/618 |
| 3,494,628 | A * | 2/1970 | Spademan | 280/624 |
| 3,844,575 | A * | 10/1974 | Salomon | 280/637 |
| 4,165,887 | A * | 8/1979 | Bunn, Jr. | 280/613 |
| 4,887,833 | A * | 12/1989 | Bailey | 280/615 |
| 5,106,118 | A | 4/1992 | Frey | 280/636 |
| 5,499,838 | A * | 3/1996 | Hauglin et al. | 280/615 |
| 5,893,576 | A * | 4/1999 | Hauglin | 280/621 |
| 5,897,127 | A | 4/1999 | Hauglin | 280/615 |
| 5,947,507 | A | 9/1999 | Quintana et al. | 280/615 |
| 5,957,478 | A | 9/1999 | Vigny | 280/615 |
| 6,092,830 | A | 7/2000 | Wheeler | 280/624 |
| 6,105,994 | A | 8/2000 | Parris et al. | 280/615 |
| 6,202,326 | B1 | 3/2001 | Hauglin | 36/117.2 |
| 6,234,514 | B1 * | 5/2001 | Dubuque | 280/619 |
| 6,299,193 | B1 | 10/2001 | Parris et al. | 280/614 |
| 6,322,095 | B1 | 11/2001 | Wheeler | 280/613 |
| 6,390,493 | B1 | 5/2002 | Hauglin | 280/615 |
| 6,409,204 | B1 | 6/2002 | Ayliffe | 280/613 |
| 6,585,248 | B2 | 7/2003 | Baud | 269/296 |
| 6,623,027 | B1 | 9/2003 | Wheeler | 280/623 |
| 6,685,213 | B2 | 2/2004 | Hauglin | 280/624 |

FOREIGN PATENT DOCUMENTS

| | | | |
|---|---|---|---|
| CH | 587065 | * | 3/1972 |

* cited by examiner

*Primary Examiner*—Christopher P. Ellis
*Assistant Examiner*—Vaughn T. Coolman
(74) *Attorney, Agent, or Firm*—Trent H. Baker; Baker & Associates PLLC

(57) ABSTRACT

The present invention relates to a radius surface for use on a ski binding resistance mechanism cartridge. The radius surface of the present invention enables a cable coupled to the resistance mechanism cartridge to bend directly adjacent to the cartridge. Since the cable is able to bend adjacent to the cartridge, the overall functionality of a binding is improved. In addition, the radius surface can be adjusted to specifically dictate the exit bend radius allowed on the cable coupled to the resistance mechanism cartridge.

18 Claims, 3 Drawing Sheets

CARTRIDGE RADIUS SURFACE

BACKGROUND OF THE INVENTION

1. Field of the Invention

The present invention relates to ski binding resistance mechanism cartridges. More particularly, the present invention relates to a ski binding resistance mechanism cartridge radius surface.

2. Background and Related Art

Telemark skiing refers to a type of skiing in which the ball of a skier's foot is bound to the ski but the heel is free to pivot. This type of connection system between the skier's foot and the ski is also used in traditional and skate style cross-country skiing. In addition, certain types of backcountry snowboards, known as splitboards, utilize a similar system in which the boarder's heel is able to pivot when the board is in its split/ski mode. All of these snow-sport activities require advanced binding systems that connect the skier/boarder to the ski/board but allow the heel to move. If a particular binding does not allow the user's heel to freely pivot, it will impede their ability to ascend a snow slope.

Various characteristics have become increasingly important in the design of ski bindings. These features include the long term durability and the overall performance of a binding. The long term durability refers to the overall life span of a binding. Most bindings include some form of straps or cables which secure a user onto a ski/board. Over time these straps or cables will often wear down and possibly snap causing the binding to fail. If the straps or cables are not easily interchangeable, the binding's life span will be dictated by the life span of the straps or cables thereby reducing the overall value of the binding. However, if the straps or cables are easily replaceable, the life span of the binding can be significantly extended. Therefore, it is desirable for a binding to include replaceable straps or cables to extend the overall life span of the binding.

The overall performance of a binding is a measurement of the binding's ability to function under a wide variety of circumstance. For example, a telemark bindings ability to maintain tension is a factor in the bindings overall performance. In addition, a telemark binding's ability to freely pivot about the ball of the foot of a user is also an important factor in a bindings overall performance. Most telemark bindings include some form of resistance mechanism or cartridge to maintain tension in the binding and reliably secure the user's foot to the ski. The positioning of the resistance mechanism can sometimes impede the horizontal or vertical pivoting allowed by the binding. For example, in many telemark bindings, two resistance mechanisms are disposed in line with the cable attachments system to allow for even tension. For protection and functionality purposes, the resistance mechanisms are often covered with cylindrical tubes/cylinders. In certain circumstances, the tubes/cylinders abut the cables coupling the user's boot to the ski thereby impeding their ability to pivot their boot with respect to the ski. In order to preserve a user's ability to freely pivot his or her foot vertically and horizontally, it is desirable to design an attachment mechanism between a resistance mechanism/cartridge and a cable that allows for a full range of movement.

Therefore, there is a need for an attachment mechanism that allows for full range of movement without preventing the cables or straps to be replaceable.

SUMMARY OF THE INVENTION

The present invention relates to a radius surface for use on a ski binding resistance mechanism cartridge. The radius surface of the present invention enables a cable coupled to the resistance mechanism cartridge to bend directly adjacent to the cartridge. Since the cable is able to bend adjacent to the cartridge, the overall functionality of a binding is improved. In addition, the radius surface can be adjusted to specifically dictate the exit bend radius allowed on the cable coupled to the resistance mechanism cartridge.

In one embodiment, the radius surface is a connector between a resistance mechanism cartridge and a cable that allows the cable to be bent at a particular range directly adjacent to the resistance mechanism cartridge. The term "radius surface" is used broadly to include a surface with any combination of curved, non-linear, partially curved, discontinuous, flat, grooved, spline, etc surfaces. The connector involves coupling the cable to the resistance mechanism cartridge internally thereby allowing the cable to bend directly upon exiting the resistance mechanism cartridge. Various internal connection systems may be utilized and remain consistent with the present invention. The bending range of the cable is specifically dictated by the curvature of the outermost portion of the resistance mechanism cartridge upon which the cable exits. This outermost portion of the resistance mechanism cartridge is referred to generally as the radius surface.

While the methods and processes of the present invention have proven to be particularly useful in the area of ski bindings, those skilled in the art can appreciate that the methods and processes can be used in a variety of different applications and in a variety of different areas of manufacture.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to a radius surface for use on a ski binding resistance mechanism cartridge. The radius surface of the present invention enables a cable coupled to the resistance mechanism cartridge to bend directly adjacent to the cartridge. Since the cable is able to bend adjacent to the cartridge, the overall functionality of a binding is improved. In addition, the radius surface can be adjusted to specifically dictate the exit bend radius allowed on the cable coupled to the resistance mechanism cartridge. While embodiments of the present invention are directed towards a radius surface for use on a ski binding resistance mechanism cartridge, it will be appreciated that the teachings of the present invention are applicable to other fields. For example, the teachings of the present invention may be applied to various cartridges that do not contain resistance mechanisms.

Resistance mechanism cartridges are used on a variety of ski bindings including telemark bindings. The resistance mechanisms are necessary for maintaining tension on the skiers boot while coupled to the ski. The resistance mechanisms are also necessary to allow for even pivoting while in operation. Some telemark bindings include one resistance mechanism while most bindings include two. It is generally necessary to shield the resistance mechanism from damage and debris with a cartridge. The term "resistance mechanism" is used broadly to include but not be limited to a spring, an elastomer member, etc. The term "ski" and "binding" are used in this application in the broadest sense to include all types of skis and bindings. For example, the definition of "ski" includes but is not limited to telemark skis, cross country skis, alpine skis, split board skis, sled ski tracks, etc. Likewise, the definition of "binding" includes but is not limited to telemark bindings, cross country bindings, alpine bindings, snowboard bindings, skateboard bindings, kiteboard bindings, wakeboard bindings, sled ski track attachments, etc.

Figure 1:
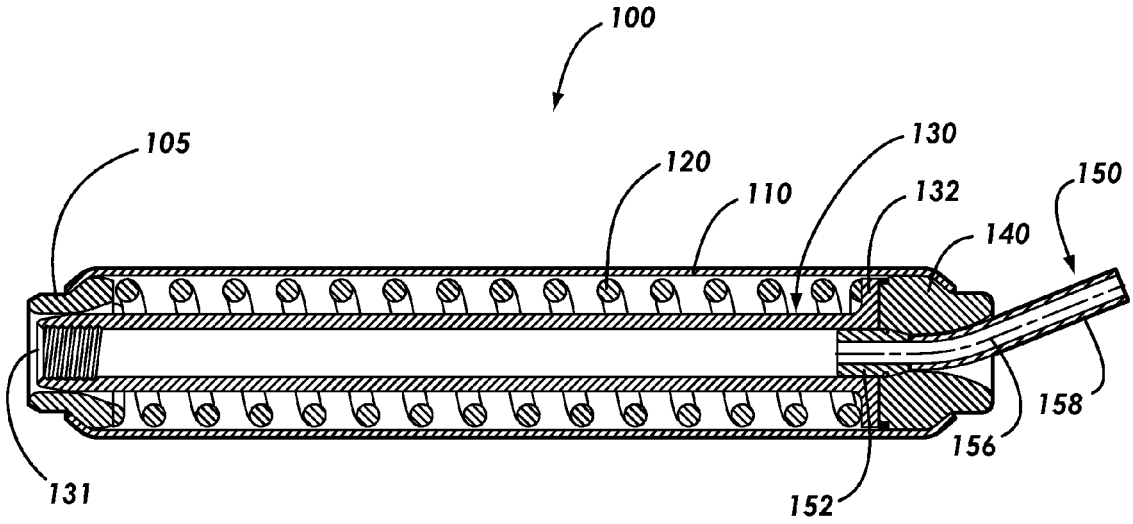
FIG. 1 illustrates a cross-sectional view of a resistance mechanism cartridge for use with a binding in accordance with embodiments of the present invention.

Reference is first made to FIG. 1, which illustrates a cross-sectional view of a resistance mechanism cartridge for use with a binding in accordance with the present invention, designated generally at 100. The resistance mechanism cartridge 100 includes an entrance connector 105, an outer housing 110, a resistance mechanism 120, a flared tube 130, an exit connector 140, and a cable 150. The outer housing is composed of a rigid material including but not limited to metal or plastic and is designed to protect the remainder of the cartridge from impacts and snow. It is desirable to minimize the impact forces on the resistance mechanism 120 and the connectors 105, 140 to maintain reliability of the cartridge. The outer housing 110 may also include various identification marks indicating the type of connection system and the strength of the resistance mechanism 120.

The entrance and exit connectors 105, 140 are designed to couple two independent cables or wires to the resistance mechanism cartridge 100. Various types of entrance connectors 105 may be utilized and remain consistent with the present invention. For example, a threaded connector, a wedge connector, a keyed connector, etc. The entrance connector 105 of the present invention utilizes a flared tube 130 with a female threaded end 131 disposed within the entrance connector 105. The female threaded end 131 includes a recess that must be large enough for the cable 150 to be dropped through or removed. An entrance cable equipped with a male threaded portion (not shown) is coupled to the entrance connector 105 by simply positioning it within the female threaded end 131 and rotating the entire resistance mechanism cartridge 100 to engage the threads. The outer housing 110 is only coupled to the flared tube 130 when the resistance mechanism cartridge 100 is not under load. This disengagement system is incorporated to prevent the entrance connector 105 from inadvertently loosening or releasing.

The flared tube 130 includes a female threaded end 131 and a flared end 132. The flared tube is shaped like an elongated cylinder or tube with a flare at one end. The flared end 132 is coupled to the outer housing 110 and/or the exit connector 140 via some form of releasable coupling including but not limited to a friction or a key coupler. When the cartridge is under load, the flared end 132 compresses against the resistance mechanism 120 and disengages from the outer housing 110 and/or the exit connector 140. Therefore, when the resistance mechanism cartridge 100 is under load, the entrance connector 105 cannot be loosened or tightened by rotating the outer housing 110. This system prevents inadvertent adjustment or releasing of the entrance connector 105 during operation.

The exit connector 140 is designed to couple a cable and provide a unique radius surface for the cable 150 to bend. The cable 150 includes a wedge 152, a wire 156, and a sheath 158. The cable 150 is dropped through the entrance connector 105 until the wedge 152 is abutted against the exit connector 140 as shown. The cable 150 can also be extended back out the cartridge 100 for replacement. The wedge 152 is a swaged member coupled to the wire 156 that is designed to axially chock within a constriction. The exit connector 140 is shaped to constrict the wedge 152 in the manner shown. In addition to axially chocking between the wedge 152 and the exit connector 140, the wedge 152 also rotationally chocks within the exit connector 140. The rotational chocking is accomplished with a system including but not limited to a key or friction type coupling. The rotational chocking between the wedge 152 and the exit connector 140 further prevents the cartridge from inadvertently loosening or releasing the threaded entrance connector 105 during operation.

In addition to constricting around the wedge 152, the exit connector 140 also provides and radius surface bend radius for the cable 150 to bend around. Since the coupling between the cable 150 and the resistance mechanism cartridge 100 is accomplished entirely within the resistance mechanism cartridge 100, the cable 150 is able to bend directly adjacent to the resistance mechanism cartridge 100 as shown. The amount of bending of the cable 150 at the exit connector 140 can also be dictated by adjusting the curvature of the outermost portion of the exit connector 140.

Figure 2:
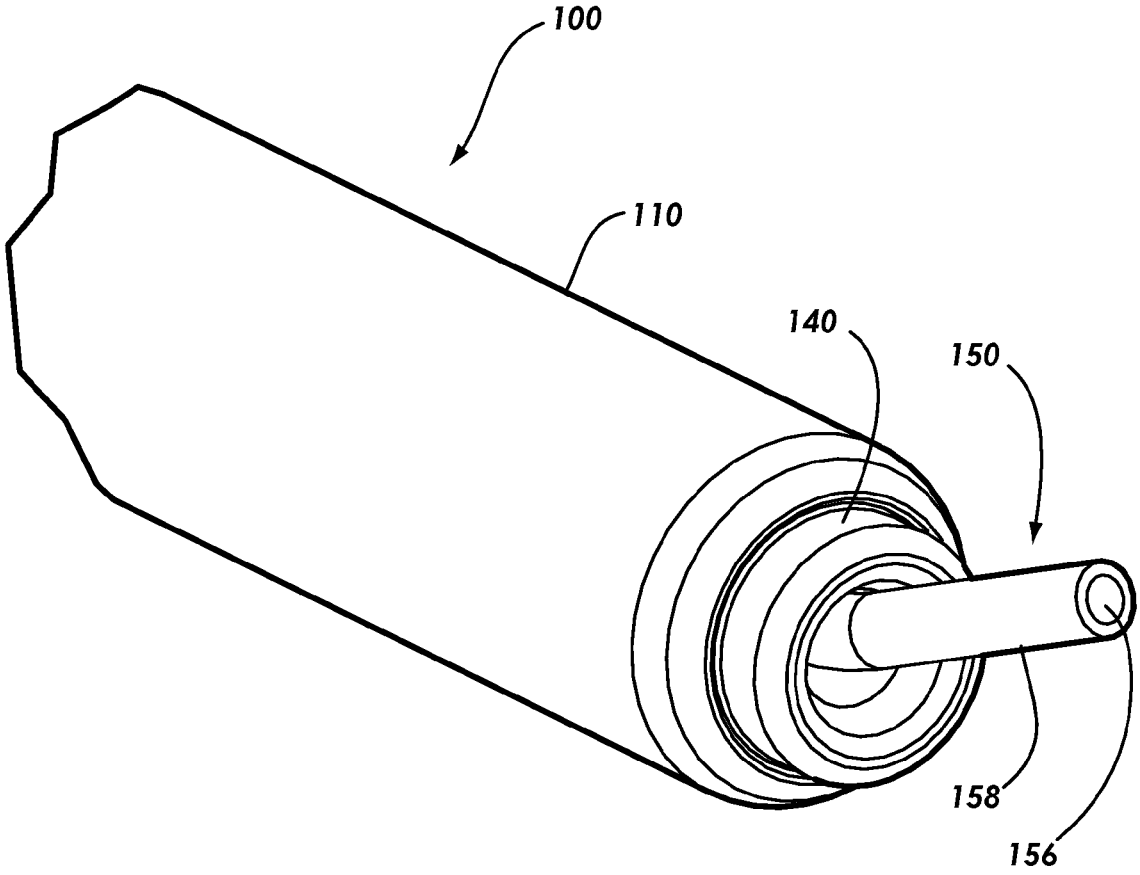
FIG. 2 illustrates a perspective view of the front portion of the resistance mechanism illustrated in FIG. 1.

Reference is next made to FIG. 2, which illustrates a perspective view of the front portion of the resistance mechanism cartridge illustrated in FIG. 1. This figures further illustrates how the cable 150 is allowed to bend directly adjacent to the resistance mechanism cartridge 100 in the present invention. The figure also illustrates how the curvature of the exit connectors 140 outermost portion directly dictates the maximum angle at which the cable is allowed to bend.

Figure 3:
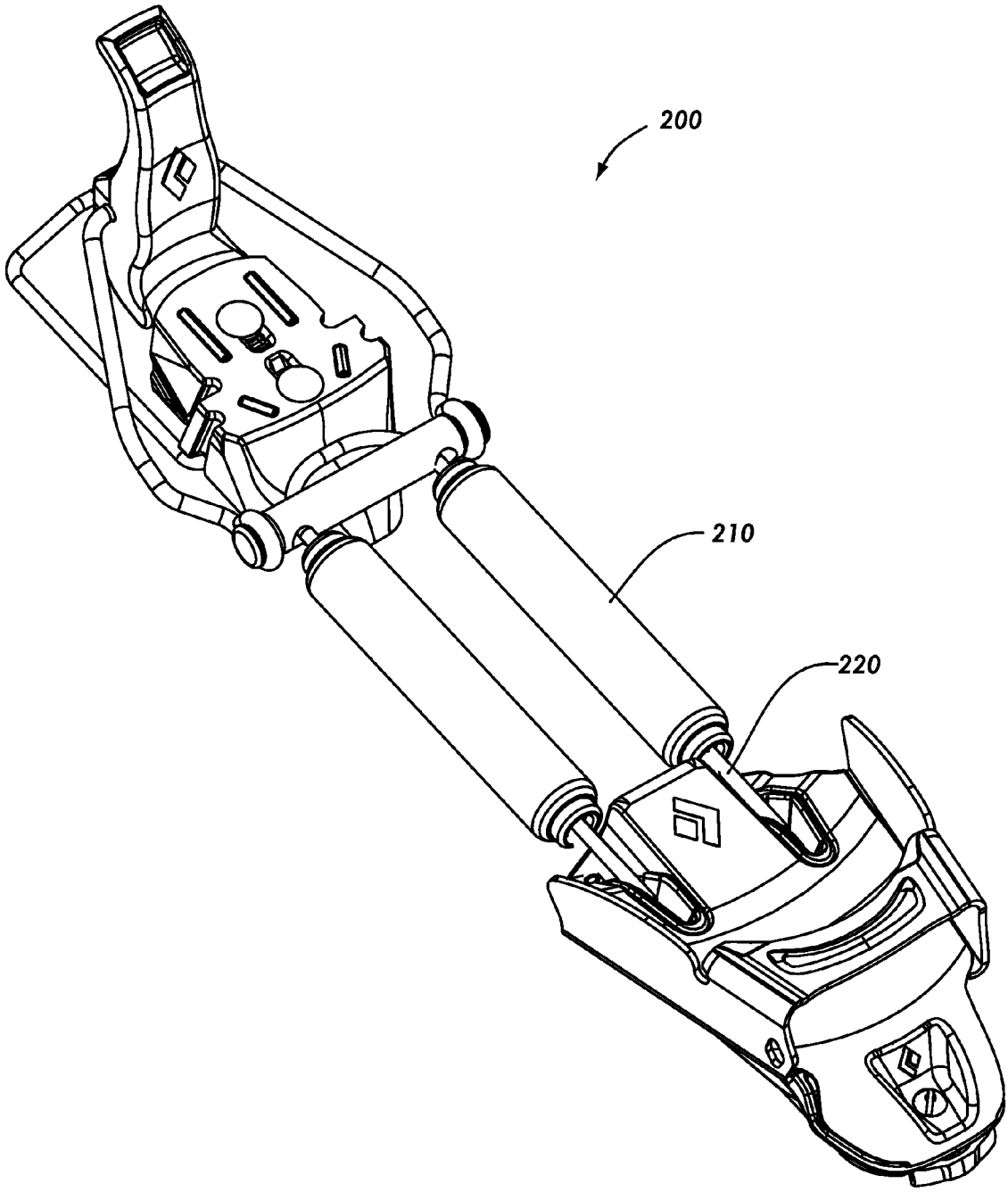
FIG. 3 illustrates a perspective view of a ski binding incorporating a resistance mechanism cartridge in accordance with embodiments of the present invention.

Reference is next made to FIG. 3, which illustrates a perspective view of a ski binding incorporating a resistance mechanism cartridge in accordance with embodiments of the present invention, designated generally at 200. The resistance mechanism cartridge is designated at 210 and a cable is designated at 220. The illustrated embodiment is of a Telemark type ski binding in which the resistance mechanism cartridge 210 is coupled to the ski binding 200 via the cable 220. The resistance properties of the resistance mechanism cartridge 210 resist a boot coupled to the ski binding 200 from pivoting with respect to the base of the binding. The resistance mechanism cartridge embodiments of the present invention may be incorporated into other binding systems in accordance with the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A coupling mechanism for use on a telemark ski binding comprising:

a cable coupled to the telemark ski binding; and a resistance mechanism cartridge coupled to the telemark ski binding via the cable, wherein the coupling between the cable and the resistance mechanism cartridge includes an internally curved radius surface that allows bending in the cable to occur directly adjacent to the resistance mechanism cartridge, and wherein the angle of curvature of the radius surface is concave with respect to the remainder of the resistance mechanism cartridge.

2. The coupling mechanism for use on a telemark ski binding of claim 1, wherein the cable is routed through the internally curved radius surface.

3. The coupling mechanism for use on a telemark ski binding of claim 1, wherein a curvature characteristic of the internally curved radius surface restricts a range of angles within which a particular point of the cable is allowed to bend, thereby protecting the cable from wear.

4. The coupling mechanism for use on a telemark ski binding of claim 1, wherein the internally curved radius surface includes an internal 360 degree fixed axial and rotational non-threaded chocking coupling system that couples the cable to the resistance mechanism cartridge.

5. A coupling mechanism comprising:

a resistance mechanism cartridge including a radius surface; and a cable internally coupled to the resistance mechanism cartridge and extending out through the radius surface, wherein an angle of curvature of the radius surface prevents cable damage by restricting a range of angles within which a particular point of the cable is allowed to bend, and wherein the internal coupling between the cable and the resistance mechanism cartridge comprises a 360 degree fixed axial and rotational non-threaded chocking internal attachment.

6. The coupling mechanism of claim 5, wherein the radius surface is internally curved so as to include the angle of curvature extending into the remainder of the resistance mechanism cartridge.

7. The coupling mechanism of claim 5, wherein a curvature characteristic of the radius surface restricts a range of angles within which a particular point of the cable is allowed to bend, thereby protecting the cable from wear.

8. The coupling mechanism of claim 5, wherein a threaded connector couples the resistance mechanism cartridge to a telemark ski binding.

9. A coupling mechanism comprising:

an outer housing;

a resistance mechanism disposed within the outer housing;

a first connector disposed on a first side of the outer housing;

a second connector disposed on a second side of the outer housing, wherein the second side is opposite the first side, and wherein the second connector includes an internally curved radius surface;

a cable releasably coupled to a fixed position of an interior region of the outer housing and extending out the second connector via the internally curved radius surface, wherein the internally curved radius surface restricts a range of angles within which a particular region of the cable is allowed to bend with respect to the outer housing, and wherein the radius surface extends from within the outer housing to outside the outer housing.

10. The coupling mechanism of claim 9, wherein the outer housing is substantially cylindrical and includes an internal channel that extends between the first and second connector.

11. The coupling mechanism of claim 9, wherein the resistance mechanism is a spring that is mechanically coupled to the outer housing and at least one of the first and second connector.

12. The coupling mechanism of claim 9, wherein first connector includes a threaded coupler mechanically coupled to the resistance mechanism.

13. The coupling mechanism of claim 9, wherein the second connector is disposed in part within the outer housing and in part outside the outer housing.

14. The coupling mechanism of claim 9, wherein the releasable coupling between the cable and the interior region includes a chocking system in which the cable is restricted within a taper of the second connector.

15. The coupling mechanism of claim 14, wherein the chocking system provides both a rotational and lengthwise chocking of the cable so as to prevent the cable from translating toward the second connector and from rotating with respect to the outer housing.

16. The coupling mechanism of claim 9, wherein the internally curved radius surface restricts a range of angles within which a particular region of the cable is allowed to bend with respect to the housing by forcing the cable to bend over a curved surface of a particular curvature thereby preventing any particular region of the cable from bending at an angle greater than that of the curved surface.

17. The coupling mechanism of claim 9, wherein radius surface includes a concave curvature with respect to the outer housing.

18. The coupling mechanism of claim 9, wherein the cable may be removed from the outer housing by extending out through the first connector.

* * * * *